US006510860B2

(12) United States Patent
Kihs

(10) Patent No.: US 6,510,860 B2
(45) Date of Patent: Jan. 28, 2003

(54) ADAPTER FOR DRAIN CLEARING TOOL

(76) Inventor: Josef K. Kihs, 301 Frances Avenue, Apt. 1106, Stoney Creek, Ontario (CA), L8E 3W6

( * ) Notice: Subject to any disclaimer, the term of this patent is extended or adjusted under 35 U.S.C. 154(b) by 145 days.

(21) Appl. No.: 09/750,363

(22) Filed: Dec. 29, 2000

(65) Prior Publication Data

US 2001/0029968 A1 Oct. 18, 2001

Related U.S. Application Data

(60) Provisional application No. 60/176,810, filed on Jan. 19, 2000.

(51) Int. Cl.[7] ..... B08B 3/04

(52) U.S. Cl. ..... 134/166 C; 134/169 C; 134/201; 4/255.05; 4/255.08; 4/255.11

(58) Field of Search ..... 134/166 R, 169 R, 134/169 C, 166 C, 198, 184, 196, 201; 4/255.05, 255.08, 255.09, 255.11; D32/35

(56) References Cited

U.S. PATENT DOCUMENTS 1,508,265 A * 9/1924 Bailey
1,941,065 A * 12/1933 Williamson
2,059,532 A * 11/1936 Nagel
2,126,689 A * 8/1938 Pouliot
2,203,185 A * 6/1940 Walus
2,526,750 A * 10/1950 Hollansworth
2,697,842 A * 12/1954 Meyer
3,537,113 A * 11/1970 Elzner
3,770,204 A * 11/1973 Schuster
4,238,860 A * 12/1980 Dixon
4,736,473 A * 4/1988 Gellatly
4,745,641 A * 5/1988 Tash
4,756,480 A * 7/1988 Fish
5,020,166 A * 6/1991 Davenport
5,598,867 A * 2/1997 Sullivan
6,185,755 B1 * 2/2001 Shepherd et al.

* cited by examiner

*Primary Examiner*—Frankie L. Stinson
(74) *Attorney, Agent, or Firm*—Robert F. Delbridge

(57) ABSTRACT

An adapter having a central tubular connecting portion to enable the adapter to be fitted to a drain clearing tool, and a flexible skirt portion of frusto-conical shape extending from the central connecting portion partway along its length. The connecting portion has a first part on one side of the skirt portion and a second part with a different diameter from the first part on the other side of the skirt portion, and the skirt portion having a first configuration in which it surrounds one of the connecting parts and a reversely bent second configuration in which it surrounds the other connecting part.

6 Claims, 5 Drawing Sheets

ADAPTER FOR DRAIN CLEARING TOOL

This application claims priority from U.S. Provisional Patent Application No. 60/176,810 filed Jan. 19, 2000.

FIELD OF INVENTION

This invention relates to drain clearing tools, and in particular to adapters which enables such tools to be used with different kinds of drain outlets.

BACKGROUND OF INVENTION

Some known drain clearing tools operate to apply fluid pressure (liquid or gas) to a drain outlet so as to dislodge blocking material in the drain. However, there is a need for an adapter for such tools to enable them to be used with different kinds of drain outlets, for example those found in washroom or kitchen sinks, showers and toilets. It is therefore an object of the invention to provide an adapter for this purpose.

SUMMARY OF INVENTION

According to the invention, an adapter for this purpose has a central tubular connecting portion to enable the adapter to be fitted to a clearing tool and a flexible skirt portion of frusto-conical shape extending from the central connecting portion part way along its length, the connecting portion having a first part on one side of the skirt portion and a second part with a different diameter from the first part on the other side of the skirt portion, and the skirt portion having a first configuration in which it surrounds one of the connecting parts and a reversely bent second configuration in which it surrounds the other connecting part.

The adapter may also have a series of circumferentially spaced stabilizing portions extending between the skirt portion and said one connecting part, which may have a larger diameter than the first connecting part. The central connecting portion may have an internal annular shoulder at the junction of the first and second connecting parts.

The invention also provides a drain clearing assembly including a drain clearing tool operable to supply food under pressure and an adapter in accordance with the invention operatively connected thereto to enable the clearing tool to be actuated to discharge food under pressure through the connecting portion of the adapter into a drain when the skirt portion is engaging the drain in a sealing manner.

The invention also provides a method of clearing a drain using a drain clearing assembly as mentioned above, including placing the skirt portion of the adapter in sealing engagement with a drain, and actuating the drain clearing tool to discharge food under pressure through the connecting portion of the adapter into a drain.

DESCRIPTION OF THE DRAWINGS

One embodiment of the invention will now be described, by way of example, with reference to the accompanying drawings, of which.

DESCRIPTION OF PREFERRED EMBODIMENT

Figure 1:
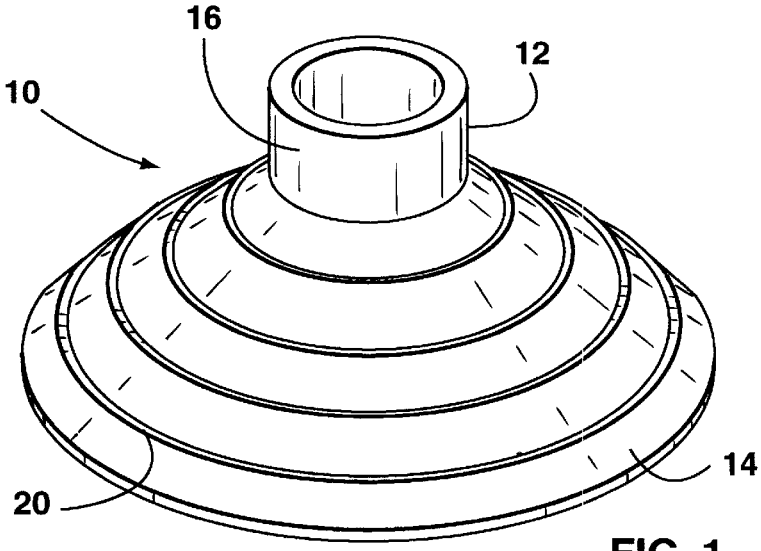
FIG. 1 is a perspective view of the top of an adapter in accordance with one embodiment of the invention, the adapter being in its first configuration.
Figure 2:
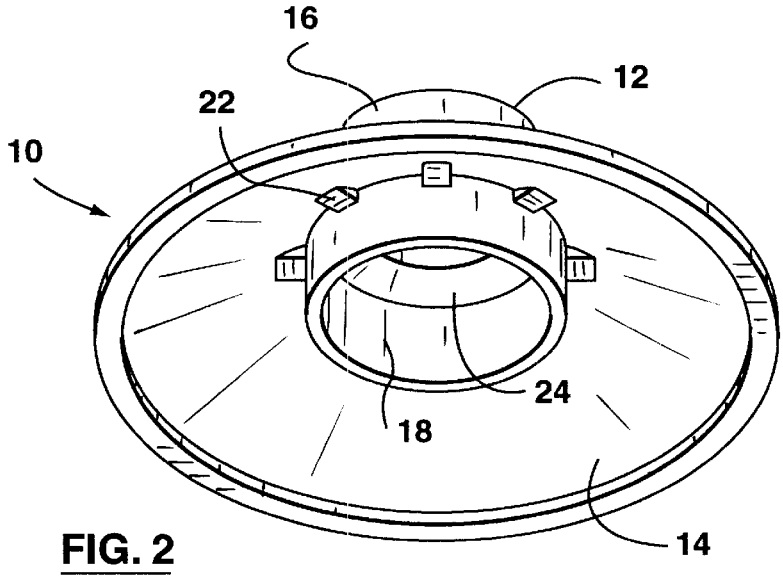
FIG. 2 is a perspective view showing the bottom of the adapter of FIG. 1.
Figure 3:
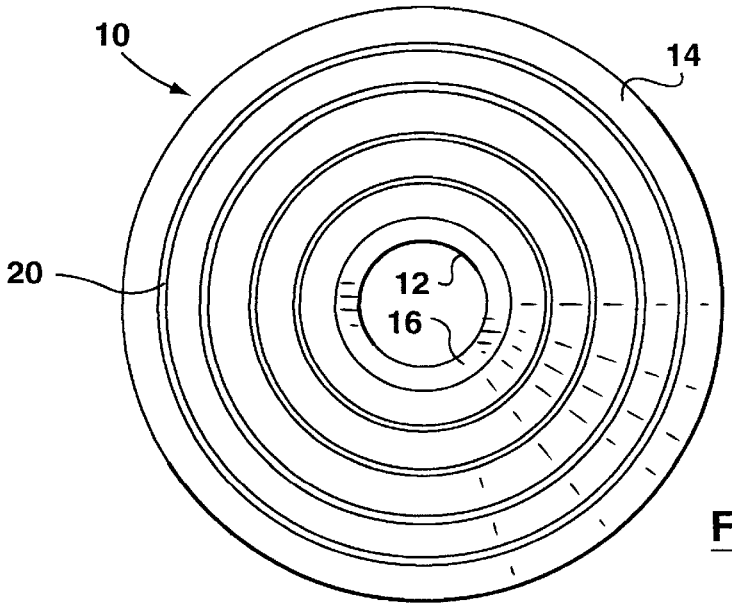
FIG. 3 is a top view thereof.
Figure 4:
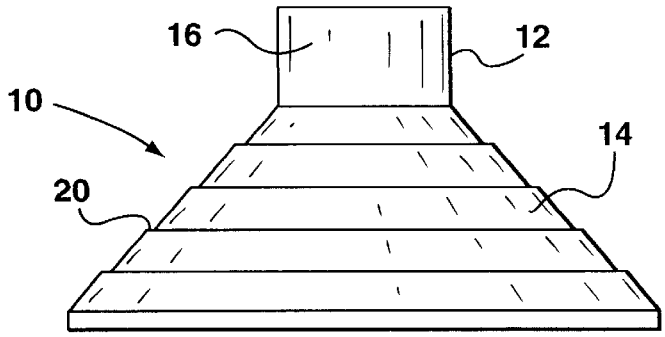
FIG. 4 is a side view thereof.
Figure 5:
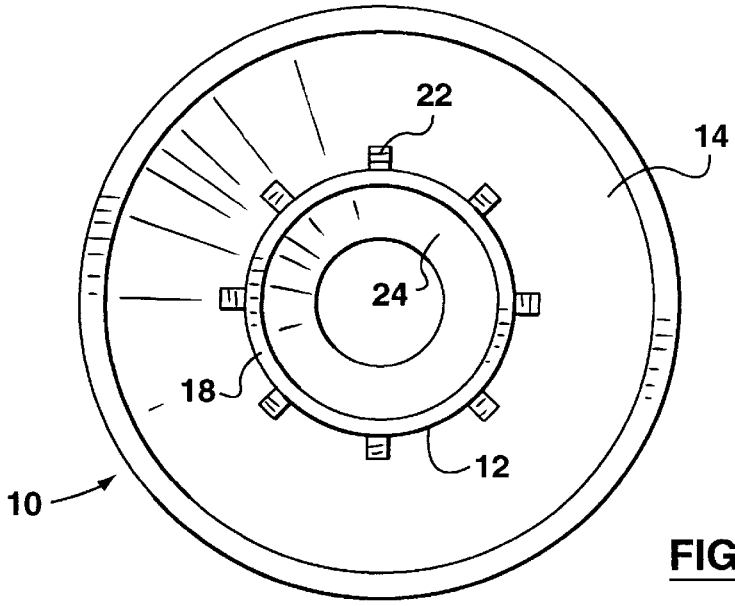
FIG. 5 is a bottom view thereof.
Figure 6:
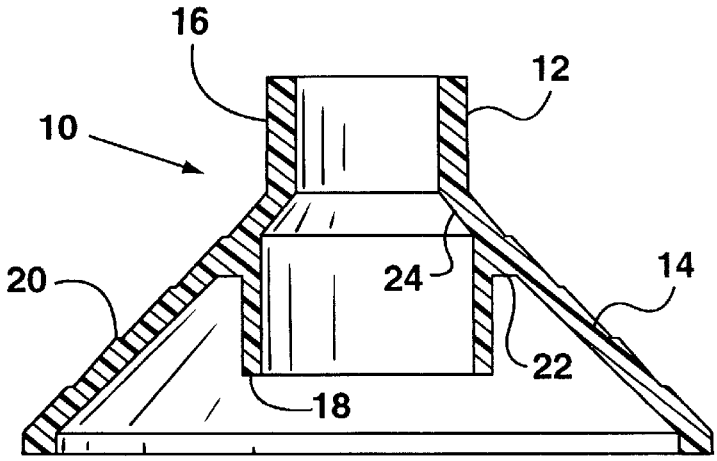
FIG. 6 is a vertical sectional view thereof.

Referring to the drawings, an adapter 10 of suitable plastic material (the nature of which will be readily apparent to a person skilled in the art from the following description) has a central tubular connecting portion 12 with a flexible skirt portion 14 of frusto-conical shape extending from and surrounding the tubular connecting portion 12 part way along its length. The connecting portion 12 has a first part 16 extending in one direction from the skirt portion 14, and a second part 18 extending in the opposite direction from the skirt portion 14, the second connecting part 18 being of substantially larger diameter than that of the first connecting part 16.

The surface of the skirt portion 14 adjacent the first connecting part 16 has a series of annular radially spaced steps 20, and a series of circumferentially spaced stabilizing portions 22 are provided between the opposite surface of the skirt portion 14 and the second connecting part 18. The connecting portion 12 has an internal annular shoulder 24 at the junction of the first and second connecting parts 16, 18.

Figure 7:
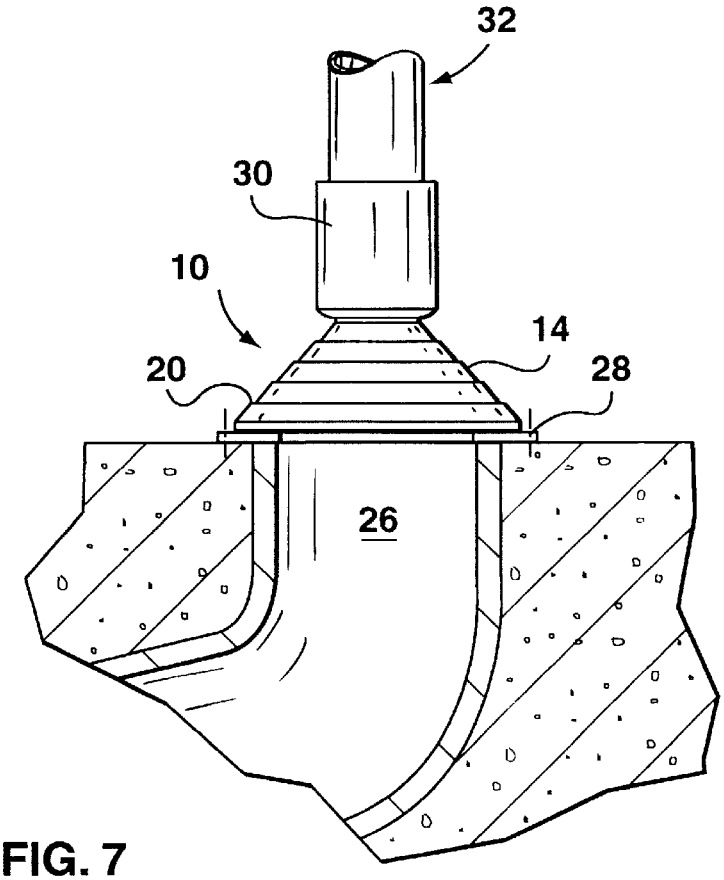
FIG. 7 is a diagrammatic view showing the adapter being used in its first configuration with a drain clearing tool to clear a drain with a removable grate.

FIGS. 1 to 6 show the adapter 10 in a first configuration, namely with the skirt portion 14 surrounding the tubular connecting part 18. In this configuration, the adapter 10 can be used for example with a shower drain 26 which has a non-removable grate 28. As shown in FIG. 7, the connecting part 16 is inserted into a sleeve 30 at the lower end of a known drain clearing tool 32 (shown more fully in FIG. 12), and the assembly is positioned so that the lower end of the skirt portion 14 of the adapter 10 engages the grate 28 in a sealing manner. The clearing tool is then actuated in known manner to discharge fluid under pressure into the drain 26 to dislodge blocking material.

Figure 8:
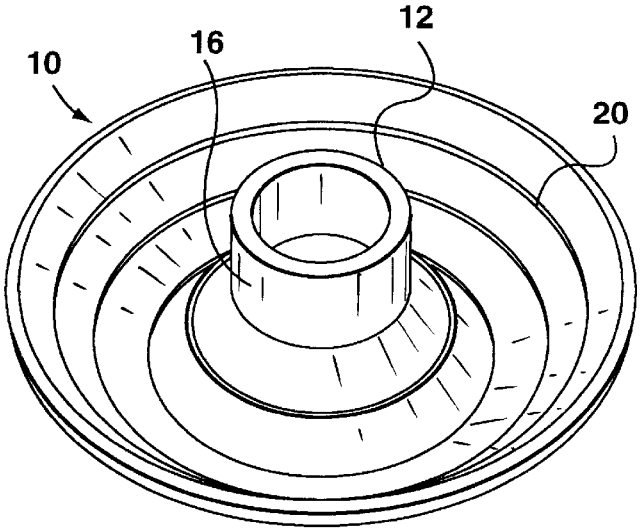
FIG. 8 is a perspective view showing the top of the adapter, with the skirt portion in its second configuration.
Figure 9:
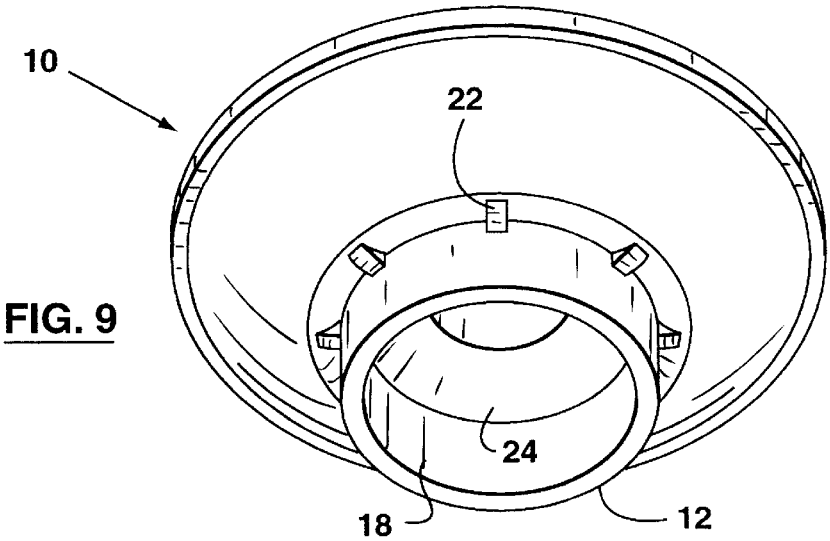
FIG. 9 is a perspective view showing the bottom thereof.
Figure 10:
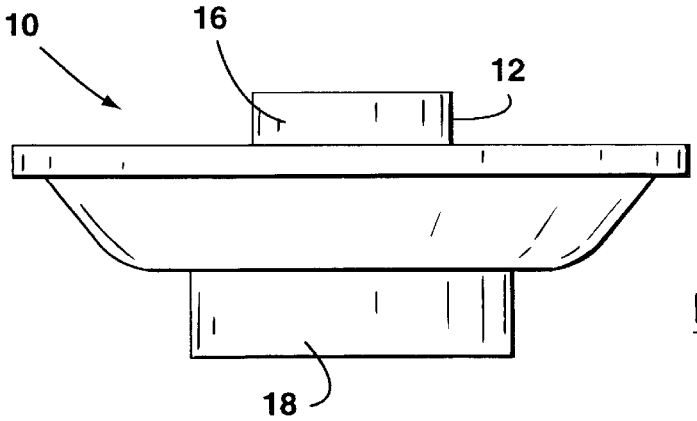
FIG. 10 is a side view thereof.

For other types of drain outlets, the adapter 10 may be used in a second configuration shown in FIGS. 8 to 10. The adapter 10 is converted from the first configuration shown in FIG. 1 to 6 to the configuration shown in FIG. 8 to 10 by reversely bending the skirt portion 14 so that it surrounds the smaller diameter connecting part 16 instead of the larger diameter connecting part 18. The stabilizing portions 22 serve to stabilize the skirt portion 14 when it is in either of the two configurations.

Figure 11:
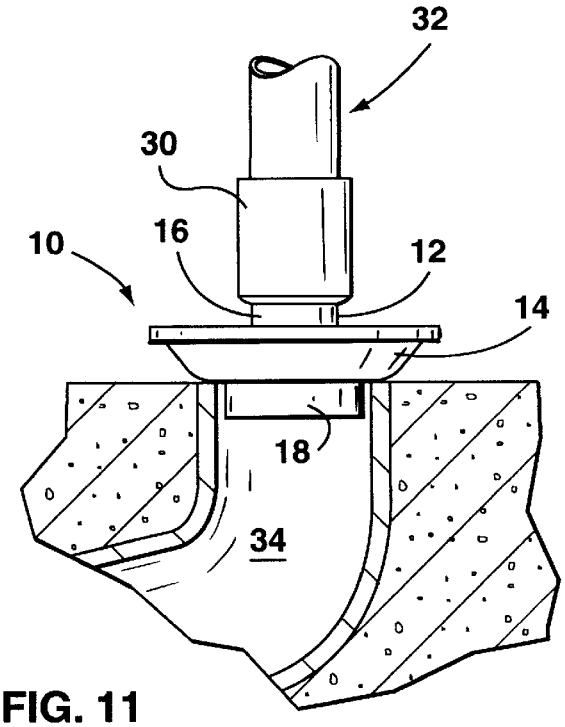
FIG. 11 is a diagrammatic view showing the adapter being used in its second configuration with a drain clearing tool to clear a drain with a removable grate.

FIG. 11 shows the adapter 10 and clearing tool 32 being used with the adapter 10 in the second configuration to clear a drain 34 with no grate, i.e. from which a removable grate has been removed. In this case, the grain 34 is engaged in a sealing manner by the reversely bent part of the skirt portion 14 adjacent the larger diameter connecting part 18.

Figure 12:
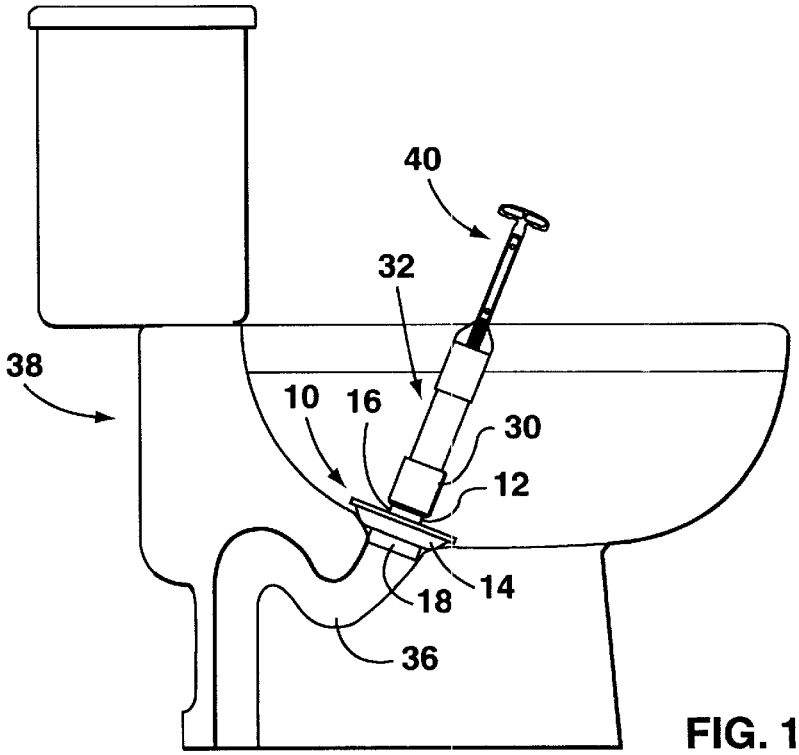
FIG. 12 is a diagrammatic view showing the adapter being used in its second configuration with the clearing tool and a handle extension to clear a toilet drain.

FIG. 12 shows an adapter 10 and clearing tool 32 being used with the adapter 10 in the second configuration to clear a drain 36 of a toilet 38. For convenience, a known extension handle 40 can be used to operate the clearing tool 32.

The advantages of the invention will now be readily apparent to a person skilled in the art from the foregoing description of a preferred embodiment and its uses. Other embodiments and uses of an adapter in accordance with the invention will also now be readily apparent, the scope of the invention being defined in the appended claims.

What is claimed is:

1. An adapter for a drain clearing tool which operates to apply fluid pressure to a drain outlet so as to dislodge blocking material in the drain, said adapter having:

a central tubular connecting portion to enable the adapter to be fitted to a drain clearing tool, and a flexible skirt portion of frusto-conical shape extending from the central connecting portion partway along its length, the connecting portion having a first part on one side of the skirt portion and a second part with a different diameter from the first part on the other side of the skirt portion, and the skirt portion having a first configuration in which it surrounds one of the connecting parts and a reversely bent second configuration in which it surrounds the other connecting part.

2. An adapter according to claim 1 also having a series of circumferentially spaced stabilizing portions extending between the skirt portion and said one connecting part.

3. An adapter according to claim 2 wherein said one connecting part has a larger diameter than the other connecting part.

4. An adapter according to claim 3 wherein the central connecting portion has an internal annular shoulder at the junction of the first and second connecting parts.

5. A drain cleaning assembly including a drain cleaning tool operable to supply fluid under pressure and an adapter in accordance with claim 1 operatively connected thereto to enable the cleaning tool to be actuated to discharge fluid under pressure through the connecting portion of the adapter into a drain when the skirt portion is engaging the drain in a sealing manner.

6. A method of clearing a drain using a drain clearing assembly in accordance with claim 5, including placing the skirt portion of the adapter in sealing contact with the drain, and actuating the drain clearing tool to discharge fluid under pressure through the connecting portion of the adapter into the drain.

* * * * *